US005246827A

United States Patent [19]

Herz et al.

[11] Patent Number: 5,246,827

[45] Date of Patent: Sep. 21, 1993

[54] PREPARATION OF PHOTOSENSITIVE SILVER HALIDE MATERIALS WITH A COMBINATION OF ORGANIC RIPENING AGENTS

[75] Inventors: Arthur H. Herz; Roger L. Klaus; Dale E. Hamilton, all of Rochester, N.Y.

[73] Assignee: Eastman Kodak Company, Rochester, N.Y.

[21] Appl. No.: 881,022

[22] Filed: May 8, 1992

[51] Int. Cl.[5] ..... G03C 1/005

[52] U.S. Cl. ..... 430/569; 430/567

[58] Field of Search ..... 430/567, 569

[56] References Cited

U.S. PATENT DOCUMENTS

| | | | |
|---|---|---|---|
| 3,271,157 | 9/1966 | McBride | 430/599 |
| 3,536,487 | 10/1970 | Graham | 430/611 |
| 3,574,628 | 4/1971 | Jones | 430/567 |
| 3,598,598 | 8/1971 | Herz | 430/607 |
| 4,221,863 | 9/1980 | Overman et al. | 430/567 |
| 4,378,424 | 3/1983 | Altland et al. | 430/611 |
| 4,631,253 | 12/1986 | Mifune et al. | 430/569 |
| 4,665,017 | 5/1987 | Mifune et al. | 430/569 |
| 4,675,276 | 6/1987 | Nakamura et al. | 430/614 |
| 4,695,524 | 9/1987 | Bryan et al. | 430/569 |
| 4,695,535 | 9/1987 | Bryan et al. | 430/569 |
| 4,713,322 | 12/1987 | Bryan et al. | 430/569 |
| 4,749,646 | 6/1988 | Herz et al. | 430/569 |
| 4,782,013 | 11/1988 | Herz et al. | 430/564 |
| 4,865,965 | 9/1989 | Friour et al. | 430/569 |
| 5,004,679 | 4/1991 | Mifune et al. | 430/569 |
| 5,028,522 | 7/1991 | Kojima et al. | 430/603 |

FOREIGN PATENT DOCUMENTS

| | | |
|---|---|---|
| 0350903 | 1/1990 | European Pat. Off. . |
| 53-82408 | 7/1978 | Japan . |
| 53-144319 | 12/1978 | Japan . |
| 55-77737 | 6/1980 | Japan . |
| 57-202531 | 12/1982 | Japan . |
| 1586412 | 3/1981 | United Kingdom . |

*Primary Examiner*—Charles L. Bowers, Jr.
*Assistant Examiner*—Mark F. Huff
*Attorney, Agent, or Firm*—Nixon, Hargrave, Devans & Doyle

[57] ABSTRACT

A photosensitive silver halide emulsion is prepared by providing an emulsion containing an anionic acid-substituted and a neutral organic ripening agent and then growing silver halide grains in the emulsion. This combination of organic ripening agents of differing charge types produces a superadditive effect on the growth of silver halide crystals.

19 Claims, No Drawings

PREPARATION OF PHOTOSENSITIVE SILVER HALIDE MATERIALS WITH A COMBINATION OF ORGANIC RIPENING AGENTS

FIELD OF THE INVENTION

The present invention relates to the preparation of photosensitive silver halide emulsions and photographic elements with supports bearing such emulsions.

BACKGROUND OF THE INVENTION

The preparation of photographic emulsions begins with the formulation of a dispersion of microcrystals of silver halide in a protective dispersing medium. Subsequent to or concurrent with the formation of these microcrystals, a silver halide solvent is introduced to permit dissolution, recrystallization, and growth of individual silver halide particles to a desired crystal (grain) size. This process is known as physical ripening and is typically carried out to increase the size of the silver halide crystals, because photographic sensitivity increases with increasing grain size. A wide variety of chemical substances function as solvents for silver halides; many are listed in T. H. James, ed., *The Theory of the Photographic Process*, 4th ed., Macmillan, New York, 1977, p. 9. Silver halide solvents are also known as Ostwald ripeners, ripening agents, crystal growth modifiers, fixing agents, and growth accelerators.

In addition to enhancing silver halide crystal size, recrystallization reactions by ripening agents at apparently fixed crystal dimensions are also known to modify silver halide morphology, to alter the concentration of crystal defects and to promote the incorporation in the silver halide crystal lattice of sensitizing species such as silver or silver sulfide clusters. These ripener-induced changes tend to increase the photographic sensitivity of silver halide emulsions, and since all these changes involve recrystallization phenomena which also participate in silver halide growth, these phenomena are included hereafter in the discussion and claim regarding silver halide growth.

Among the substances reported to be effective ripening agents are excess halide ion and ammonia, as described in G. F. Duffin, *Photographic Emulsion Chemistry*, Focal Press Ltd., London, 1966, pp. 60–62, and thiocyanate ion, as disclosed in U.S. Pat. No. 3,320,069 to Illingsworth. Many organic compounds have also been reported to function as ripeners. For example, U.S. Pat. Nos. 3,271,157 to McBride and 3,574,628 to Jones disclose the use of thioether compounds as ripening agents for silver halide photographic materials. U.S. Pat. No. 4,782,013 to Herz et al. discloses the use of macrocyclic ether compounds containing oxygen, sulfur, and selenium atoms for this purpose.

Silver halide solvents or ripening agents are generally ligands for $Ag^+$ ions that combine with $Ag^+$ ions to form soluble $Ag^+$ adducts or complex ions. Although ripening agents are very useful for controlling the size, dispersity, and morphology of silver halide grains and for determining the location of specific halide components in mixed silver halide compositions, they also cause problems in emulsions during keeping or storage. Specifically, ripeners that are retained in an emulsion after formation and growth of the silver halide grains can change the rates of chemical sensitization, interfere with spectral sensitization, and promote fog formation during storage of emulsions, particularly those coated on a support.

To avoid these undesirable effects, efforts have been made to remove organic ripeners from emulsions after formation and growth of silver halide grains by purification procedures such as washing. However these ripening agents cannot be completely removed from emulsions even by extensive wash procedures, most likely because of their relatively low aqueous solubility and their affinity for silver halide. U.S. Pat. No. 4,665,017 to Mifune et al., proposes to circumvent this difficulty by deactivating residual ripeners through an oxidation process. This approach, however, has the disadvantage that gelatin in the emulsion also undergoes irreversible changes on oxidation. Furthermore, some ripening agents, e.g., thiourea compounds, upon oxidation yield products of increased activity with respect to desensitization and fog formation.

Another approach to countering the undesirable effect of residual silver halide solvent is the addition of emulsion stabilizers and antifoggants. However, such additives tend to interfere with spectral sensitization and can lead to loss of emulsion sensitivity.

Organic silver halide solvents or ripening agents can be classified into two types: neutral and acid-substituted. A neutral ripening agent is a compound which either is uncharged or carries an equal number of positive and negative ionic charges, i.e., a zwitterionic compound. An acid-substituted ripening agent is a compound that incorporates a covalently bonded acidic function which, upon deprotonation at about pH 7 or below, confers a negative charge on the molecule. These two classes of ripening agents are exemplified by the neutral compound ethanolamine and its acid-substituted analog, glycine. Both compounds yield $Ag^+$ complexes of similar stability and are capable of ripening AgBr emulsions. However in dilute alkaline solution, where its acidic function is deprotonated, glycine dissolves AgBr much more slowly than does the neutral ethanolamine (D. Shiao, L. Fortmiller, and A. Herz, *J. Phys. Chem.*, 1975, 79, 816).

Similarly, U.S. Pat. No. 4,749,646 to Herz et al. discloses that N,N,N',N'-tetramethylthiourea accelerates silver halide grain growth, as measured by equivalent circular diameter, more than its N,N'-dicarboxymethyl-N,N'-dimethylsubstituted analog. On the other hand, the high level of storage fog induced by tetramethylthiourea is somewhat diminished when it is replaced by its N,N'-dicarboxyethyl-N,N'-dimethyl analog.

U.S. Pat. Nos. 4,695,535 to Bryan, et al., and 4,865,965 to Friour et al., also disclose acid-substituted ripening agents. The ripeners disclosed in U.S. Pat. No. 4,695,535 are acyclic thioether compounds containing carboxy substituents; the acid-substituted ripening agents disclosed in U.S. Pat. No. 4,865,965 are cyclic ethers.

The cited art makes it apparent that, when coated under a conventional condition at pH values above about 4.6, acid-substituted ripeners interfere less with dye sensitization and cause less storage fog than their neutral analogs. However, under such pH conditions the acid-substituted ripeners exist substantially in their anionic state and often suffer from the distinct disadvantage of exhibiting low activities as accelerators of silver halide growth. Hence, it is the major purpose of the present invention to overcome this barrier for the convenient application of acid-substituted ripeners in photographic systems as useful promoters of silver halide dissolution, recrystallization and growth by using them in combination with a relatively low level of a neutral organic ripener.

SUMMARY OF THE INVENTION

The present invention relates to the preparation of a photosensitive silver halide emulsion and to a photosensitive element with a support bearing that emulsion. Such emulsions are prepared by providing an emulsion comprising of:

an anionic acid-substituted organic ripening agent having the general formula (I) or (II)

$$(A)_aR^1[XR^2(A)_b]_m[YR^3(A)_c]_n \quad (I)$$

$$R^4(A)_dR^5(A)_eN-\underset{\underset{Z-R^6(A)_f}{|}}{C}=X \quad (II)$$

wherein each A is independently a covalently bonded acidic substituent;

$R^1$, $R^2$, $R^3$, $R^4$, $R^5$, and $R^6$ are independently hydrocarbon or fluorocarbon groups having from 1 to 6 carbon atoms, which groups are unsubstituted or substituted with one or more neutral functional groups containing heteroatoms selected from the group consisting of halogen, oxygen, sulfur, and nitrogen;

X is selected from the group consisting of S, Se, and Te; and

Y is selected from the group consisting of O, S, Se, and Te; a, b, and c are independently 0, 1, or 2, and at least one of a, b, or c is greater than zero, m and n are independently zero to 6;

Z is selected from the group consisting of O, S, Se, Te, and $-NR^7(A)_g$, wherein $R^7$ is a lower hydrocarbon group which is unsubstituted or substituted as described for $R^1$, $R^2$, $R^3$, $R^4$, $R^5$, and $R^6$;

d, e, f, and g are independently 0 or 1, and at least one of d, e, f, and g is 1; and a neutral organic ripening agent having the general formula (III) or (IV)

$$R^1(XR^2)_m(YR^3)_n \quad (III)$$

$$R^4R^5N-\underset{\underset{Z-R^6}{|}}{C}=X \quad (IV)$$

wherein m and n are independently zero to 6;

$R^1$, $R^2$, $R^3$, $R^4$, $R^5$, and $R^6$ are independently hydrocarbon or fluorocarbon groups having from 1 to 6 carbon atoms, which groups are unsubstituted or substituted with one or more neutral functional groups containing heteroatoms selected from the group consisting of halogen, oxygen, sulfur, and nitrogen;

X is selected from the group consisting of S, Se, and Te; and

Y is selected from the group consisting of O, S, Se, and Te; and

Z is selected from the group consisting of O, S, Se, Te, and $-NR^7$, wherein $R^7$ is a hydrocarbon group which is unsubstituted or substituted as described for $R^1$, $R^2$, $R^3$, $R^4$, $R^5$, and $R^6$; and growing silver halide grains in the emulsion.

The combination of anionic acid-substituted and neutral organic ripening agents is highly advantageous, because it produces a superadditive effect on silver halide grain growth without adversely affecting sensitization or inducing fog.

DETAILED DESCRIPTION OF THE INVENTION

Photosensitive silver halide emulsions are prepared by a process comprising:

providing an emulsion comprising:

an anionic acid-substituted organic ripening agent having the general formula (I) or (II)

$$(A)_aR^1[XR^2(A)_b]_m[YR^3(A)_c]_n \quad (I)$$

$$R^4(A)_dR^5(A)_eN-\underset{\underset{Z-R^6(A)_f}{|}}{C}=X \quad (II)$$

wherein each A is independently a covalently bonded acidic substituent;

$R^1$, $R^2$, $R^3$, $R^4$, $R^5$, and $R^6$ are independently hydrocarbon or fluorocarbon groups having from 1 to 6 carbon atoms, which groups are unsubstituted or substituted with one or more neutral functional groups containing heteroatoms selected from the group consisting of halogen, oxygen, sulfur, and nitrogen;

X is selected from the group consisting of S, Se, and Te; and

Y is selected from the group consisting of O, S, Se, and Te;

a, b, and c are independently 0, 1, or 2, and at least one of a, b, or c is greater than zero, m and n are independently zero to 6;

Z is selected from the group consisting of O, S, Se, Te, and $-NR^7(A)_g$, wherein $R^7$ is a lower hydrocarbon group which is unsubstituted or substituted as described for $R^1$, $R^2$, $R^3$, $R^4$, $R^5$, and $R^6$;

d, e, f, and g are independently 0 or 1, and at least one of d, e, f, and g is 1; and a neutral organic ripening agent having the general formula (III) or (IV)

$$R^1(XR^2)_m(YR^3)_n \quad (III)$$

$$R^4R^5N-\underset{\underset{Z-R^6}{|}}{C}=X \quad (IV)$$

wherein m and n are independently zero to 6;

$R^1$, $R^2$, $R^3$, $R^4$, $R^5$, and $R^6$ are independently hydrocarbon or fluorocarbon groups having from 1 to 6 carbon atoms, which groups are unsubstituted or substituted with one or more neutral functional groups containing heteroatoms selected from the group consisting of halogen, oxygen, sulfur, and nitrogen;

X is selected from the group consisting of S, Se, and Te; and

Y is selected from the group consisting of O, S, Se, and Te; and

Z is selected from the group consisting of O, S, Se, Te, and $-NR^7$, wherein $R^7$ is a hydrocarbon group which is unsubstituted or substituted as described for $R^1$, $R^2$, $R^3$, $R^4$, $R^5$, and $R^6$; and growing silver halide grains in the emulsion.

As previously described, an acid-substituted organic ripening agent contains a covalently bonded acidic function which, upon deprotonation at about pH 7 or below, confers a negative charge on the molecule. Also, as previously described, a neutral organic ripening agent is a compound that either is uncharged or carries an equal number of positive and negative ionic charges.

The acidic groups on the acid-substituted organic ripeners can, in accordance with the present invention, be selected from the group consisting of —CONHOH, —OPO(OR')OH, —PO(PR')OH, —COOH, —$SO_3H$, —$SO_2H$, —$SeO_3H$, —$SeO_2H$, —$CH(CN)_2$, —SH, —$SO_2SH$, —SeH, —$SO_2SeH$, —CONHCOR', —$CONHSO_2R'$, —$SO_2NHSO_2R'$, and —CR'=NOH, where R' is H or a lower alkyl or aryl group.

The $R^1$, $R^2$, $R^3$, $R^4$, $R^5$, and $R^6$ substituents on the ripening agents are each independently hydrocarbon or fluorocarbon groups having from 1 to 6 carbon atoms, which groups are unsubstituted or substituted with one or more neutral functional groups containing heteroatoms selected from the group consisting of halogens, oxygen, sulfur, and nitrogen. Particularly useful functional groups are independently selected from the group consisting of —OH, —$COR^9$, —$OR^9$, —$CONHR^9$, —$SONHR^9$, and —$SO_2R^9$, where $R^9$ is a lower hydrocarbon group that is unsubstituted or substituted as described for $R^1$, $R^2$, $R^3$, $R^4$, $R^5$, and $R^6$. $R^1$ can be linked with $R^2$ or $R^3$ to form a cyclic group having fewer than 36 ring atoms. $R^2$ can contain one or more divalent groups or atoms selected from the group consisting of —CO—, —O—, —$CONR^8$—, —S(O)—, —S-$(O_2)$—, —$SO_2NR^8$—, where $R^8$ is a lower hydrocarbon group that is substituted or unsubstituted as described for $R^1$, $R^2$, $R^3$, $R^4$, $R^5$, and $R^6$. $R^4$ and $R^6$, or $R^4$ and $R^5$, can be linked to form a 5- or 6-membered ring, such as an azole, imidazolidine, thiazolidine, thiazoline, or morpholine.

The $Ag^+$ binding sites contained in acid-substituted and neutral organic ripening agents, or ripeners, are not particularly limited. Preferred sites are atoms in Group V of the Periodic Table, preferably nitrogen or phosphorus compounds exemplified by amines and phosphines, and atoms in Group VI, in particular, sulfur, selenium, and tellurium.

Acid-substituted and neutral organic ripeners that are particularly useful for the practice of the present invention belong to the class of ether compounds. This class includes the thioethers of the previously-mentioned U.S. Pat. Nos. 3,271,157, 3,574,628, and 4,695,535 and the macrocyclic ethers of the previously-mentioned U.S. Pat. Nos. 4,782,013 and 4,865,965, the thioethers of U.S. Pat. No. 4,695,534 to Bryan et al., the selenoethers of U.S. Pat. No. 5,028,522 to Kojima et al., and the thio-, seleno-, and telluro-ether compounds disclosed in U.S. Pat. No. 5,004,679 to Mifune et al., all of which are hereby incorporated by reference. Also included for the practice of this invention are the neutral and acid-substituted cyclic and acyclic thionamides and their selenium analogs as exemplified by the thiourea compounds of U.S. Pat. No. 4,221,863. Japanese Public Disclosure 82408/1978 and the previously-mentioned U.S. Pat. No. 4,749,646 as well as the Japanese Patent Application Open to Public Inspection (OPI) Nos. 144319/78, 82408/78 and 77737/80. Further included for the practice of this invention are the thionamides of U.S. Pat. Nos. 3,536,487 to Graham, and 3,598,598 to Herz and of British Patent Specifications 1,586,412 to Fuji. Other useful ripening agents are thiols (mercaptans) such as the compounds of Japanese Patent Application (OPI) No. 202531/82 and their selenol analogs. Similarly useful for practicing this invention are the ripeners and silver halide solvents belonging to the class of triazolium thiolates; this class of compounds is discussed in U.S. Pat. No. 4,378,424 to H. Altland et al.; U.S. Pat. No. 4,631,253 to H. Mifune et al.; U.S. Pat. No. 4,675,276 to K. Nakamura et al. All these various types and classes of compounds are hereby incorporated by reference. The acid group of the acid-substituted organic ripening agents should have a pka of about 1 to about 8, preferably about 3 to about 6.

The acid-substituted and neutral organic ripeners can, in accordance with the invention, be used at any pH below about pH 13, but, preferably, in the range between about 4.6 and 7. The silver halide grains of the emulsion can be modified at temperatures between about 30° to about 90° C., preferably between about 35° to about 70° C. Also, in accordance with the present invention, the concentration of silver halide in the emulsion can be from $10^{-5}$ to 5 mole/liter, preferably from $10^{-3}$ to 2 mole/liter. The concentration of acid-substituted organic ripening agent can be from $10^{-6}$ to $10^{-1}$ mole/mole of silver halide, preferably from $10^{-4}$ to $10^{-2}$ mole/mole of silver halide. The concentration of neutral organic ripening agent can be from 0.01 to 2.5 mole/mole of acid-substituted organic ripening agent, preferably from 0.05 to 0.5 mole/mole of acid-substituted organic ripening agent.

Specific examples of acid-substituted and neutral organic ripeners that can be used in the present invention are given in Tables I and II, respectively.

TABLE I

| Compound | Acid-Substituted Silver Halide Solvents and Ripeners<br>Structure |
|---|---|
| A1 | $H_2NCH_2COOH$ |
| A2 | 4,5-dicarboxyimidazole |
| A3 | tri(carboxyethyl)phosphine |
| A4 | m-sulfophenyldimethylphosphine |
| A5 | $Te(CH_2COOH)_2$ |
| A6 | $Te(CH_2CH_2COOH)_2$ |
| A7 | $HOCH_2CH_2TeCH_2CH_2SO_3H$ |
| A8 | $CH_2(CH_2TeCH_2CH_2CH_2TeCH_2COOH)_2$ |
| A9 | $(CH_2OCH_2CH_2SCH_2CH_2COOH)_2$ |
| A10 | $(CH_2SCH_2COOH)_2$ |
| A11 | $S(CH_2CH_2SCH_2COOH)_2$ |
| A12 | $(CH_2SCH_2CH_2SCH_2COOH)_2$ |
| A13 | $O(CH_2CH_2OCH_2CH_2SCH_2CH_2SCH_2CH_2COOH)_2$ |
| A14 | $(CH_2OCH_2CH_2SCH_2CH_2SCH_2CH_2COOH)_2$ |
| A15 | $O(CH_2CH_2SCH_2CH_2COOH)_2$ |
| A16 | 1,10-dithia-4,7,13,16-tetraoxacyclooctadecane-5-carboxylic acid |
| A17 | 1,10-dithia-4,7,13,16-tetraoxacyclooctadecane-5-methyleneoxyacetic acid |
| A18 | $[HOOC(CH_2)_3]N(CH_3)CSN(CH_3)[(CH_2)_3COOH]$ |

TABLE I-continued

| Compound | Acid-Substituted Silver Halide Solvents and Ripeners<br>Structure |
|---|---|
| A19 | 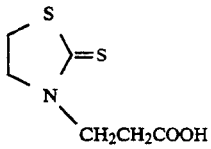 |
| A20 | 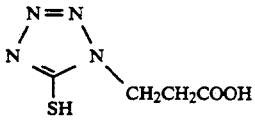 |
| A21 | 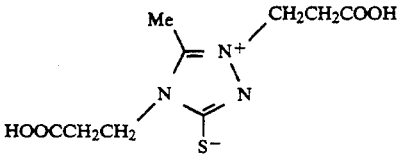 |
| A22 | 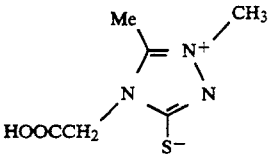 |
| A23 | 1,10-diselena-4,7,13,16-tetraoxacyclooctadecane-5-carboxylic acid |
| A24 | $(CH_2OCH_2CH_2SeCH_2CH_2COOH)_2$ |
| A25 | $(CH_2OCH_2CH_2SeCH_2CH_2CONHCH_2COOH)_2$ |
| A26 | $(CH_2CH_2—SO—CH_2CH_2SeCH_2CH_2COOH)_2$ |
| A27 | $(CH_2OCH_2CH_2SeCH_2CH_2CH_2COOH)_2$ |
| A28 | $O(CH_2CH_2CH_2SeCH_2CH_2COOH)_2$ |
| A29 | $O(CH_2CH_2CH_2SeCH_2CH_2CH_2SeCH_2CH_2COOH)_2$ |
| A30 | 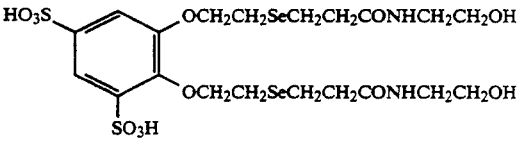 |
| A31 | 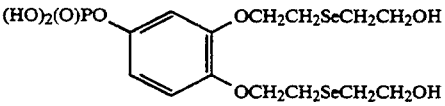 |
| A32 | 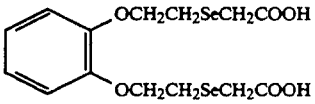 |

TABLE II

| Compound | Neutral Silver Halide Solvents and Ripeners<br>Structure |
|---|---|
| N1 | $(CH_2SCH_2OH)_2$ |
| N2 | $(CH_2OCH_2CH_2SCH_2CH_2OH)_2$ |
| N3 | $(CH_2OCH_2CH_2SCH_2CH_2OCH_3)_2$ |
| N4 | $Te(CH_2CH_2OH)_2$ |
| N5 | $CH_2(CH_2TeCH_2CH_2OH)_2$ |
| N6 | $(CH_2OCH_2CH_2SeCH_2CH_2CH_2OH)_2$ |
| N7 | Ethanolamine |
| N8 | Pyridine |
| N9 | $H_2NCOCH(CH_2OCH_2CH_2NH_2)_2$ |
| N10 | $P(CH_2CH_2CN)_3$ |
| N11 | $(CH_2OCH_2CH_2SeCH_2CH_2CONHEt)_2$ |
| N12 | 1,10-dithia-4,7,13,16-tetraoxacyclooctadecane |

TABLE II-continued

| Compound | Neutral Silver Halide Solvents and Ripeners<br>Structure |
|---|---|
| N13 | 1,7-dithia-4,10,13,16-tetraoxacyclooctadecane |
| N14 | 1,10-diselena-4,7,13,16-tetraoxacyclooctadecane |
| N15 | $Me_2NCSNMe_2$ |
| N16 | $Me_2NCSeNMe_2$ |
| N17 | 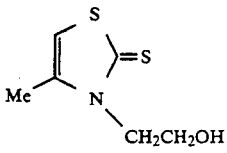 |

TABLE II-continued

| Neutral Silver Halide Solvents and Ripeners | |
|---|---|
| Compound | Structure |
| N18 | 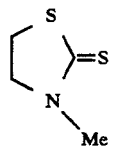 |
| N19 | 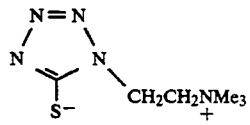 |
| N20 | 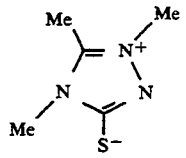 |
| N21 | 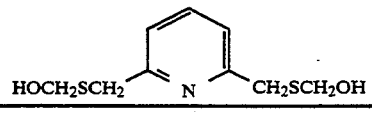 |

In accordance with the present invention, the combination of acid-substituted and neutral organic ripening agents can be added to a solution of the dispersion medium, e.g., gelatin, at any stage before, during or after formation and chemical or physical ripening of the silver halide emulsion. These ripeners can be added simultaneously or singly in any order. The procedure for growing silver halide grains with the combination of acid-substituted and neutral organic ripeners can be accomplished by any of the processes generally known in the art and can be achieved at any step of emulsion formation, preparation and sensitization. That process includes growth of silver halide emulsions which were formed in the absence of any ripener where, after completion of silver halide formation, the ripener combination is added to the emulsion which, optionally, may contain other additives such as sensitizers of the spectral or chemical type, or growth-modifying agents such as azaindenes or thiol compounds, or a combination of organic or inorganic ripeners in addition to the acid-substituted ripeners of this invention. Also included are the art-recognized single jet and multi-jet procedures for silver halide formation; among the latter, the double jet technique is preferred and the ripener combination, singly or jointly, can be introduced at any stage when this technique is used.

The silver halide emulsions grown and sensitized by the process of the present invention can be silver chlorides, silver iodides or silver bromides of any crystal habit or shape, including tabular and needle forms. The silver halides can also consist of mixed halide compositions, e.g. bromoiodides or chloride-rich compositions containing at least 50 mole % silver chloride. In mixed halide compositions, the various silver halides can be randomly distributed throughout the crystal or their location can be specified, for example, an emulsion having a silver chloride core and an 8 mole % silver bromide shell with a surface layer of silver iodide not exceeding 1 mole %. The process of the present invention can be carried out at any suitable temperature at pH values ranging between about pH 1 to about pH 8, the preferred range being between about pH 4.6 and about pH 7; particularly preferred pH values fall in the range between about pH 5.3 and pH 6.7. The formation and growth of the silver halide emulsion according to this invention can be accomplished with either excess silver ions or excess halide ions, but the preferred condition for growth involves 0 to about 500 mM excess halide ions, preferably between about 0.001 and 50 mM excess halide. Emulsion purification procedures before coating are optional, and gelatin is the preferred colloid and vehicle for the photosensitive silver halide emulsion of the present invention. Other vehicles are disclosed in Section IX of *Research Disclosure*, Item 308119, December 1989, hereinafter referred to as *Research Disclosure*, hereby incorporated by reference.

The emulsions of the present invention can contain ionic antifogging agents and stabilizers such as thiols, thiazolium compounds, exemplified by benzothiazolium salts and their selenium and tellurium analogs, thiosulfonate salts, azaindenes and azoles. Also included among these antifoggants and stabilizers are compound classes which, depending on their substituents, can either be ionic or non-ionic; these classes include disulfides, diselenides and thionamides. Also specifically included are non-ionic antifoggants and stabilizers such as the hydroxycarboxylic acid derivatives of W. Humphlett in U.S. Pat. No. 3,396,028 and the polyhydroxyalkyl compounds of U.S. patent application Ser. No. 493,598, entitled "Stabilization of Photographic Recording Materials" to Lok and Herz.

The emulsions of the present invention can contain chemical sensitizers such as those based on sulfur, selenium, silver or gold, or combinations of such sensitizers. Other sensitizing agents are disclosed in Section III of *Research Disclosure*, hereby incorporated by reference.

The photographic emulsions of the present invention can be spectrally sensitized with dyes such as cyanines, merocyanines, or other dyes shown in Section IV of *Research Disclosure*, hereby incorporated by reference.

The photographic emulsions of the present invention can contain color image forming couplers, i.e., compounds capable of reacting with an oxidation product of a primary amine color developing agent to form a dye. They can also contain colored couplers for color correction or development inhibitor-releasing (DIR) couplers. Suitable couplers for the practice of the present invention are disclosed in Section VII of *Research Disclosure*, hereby incorporated by reference.

The photographic emulsions of the invention can be coated on various supports, preferably flexible polymeric films. Other supports are set forth in Section XVII of *Research Disclosure*, hereby incorporated by reference.

Emulsions of the present invention can be applied to a multilayer multicolor photographic material comprising a support on which is coated at least two layers having different spectral sensitivities. Such multilayer multicolor photographic materials usually contain at least one red-sensitive emulsion layer, at least one green-sensitive emulsion layer, and at least one blue-sensitive emulsion layer. The order of these layers can be optionally selected as desired. Usually a cyan-forming coupler is associated with the red-sensitive layer, a magenta-forming coupler is associated with the green-sensitive layer, and a yellow-forming coupler is associated with the blue-sensitive layer.

The photographic emulsions of the present invention can be processed with black and white developing agents such as hydroquinones, 3-pyrazolidones, or other compounds such as those disclosed in Section XX of *Research Disclosure*, hereby incorporated by reference. Primary aromatic amine color developing agents (e.g., 4-amino-N-ethyl-N-hydroxyethylaniline or 3-methyl-4-amino-N,N-diethylaniline) can also be employed. Other suitable color developing agents are described in L. F. A. Mason, *Photographic Processing Chemistry*, Focal Press, 1966, pp. 226–229, and in U.S. Pat. Nos. 2,193,015 and 2,592,364.

Photographic emulsions of the present invention can be applied to many different silver halide photographic materials such as, high speed black and white films, X-ray films, and multilayer color negative films, including those having diffusion transfer applications.

As demonstrated by the following examples, the combination of an acid-substituted organic ripening agent and a neutral ripening agent in accordance with the present invention achieves a superadditive effect on silver halide growth, an effect which is not obtained by a combination of ripeners belonging to the same charge type. In addition, the combination of acid-substituted and neutral organic ripening agents of the present invention requires no subsequent removal or deactivation of these agents, because they cause no deleterious effects such as, desensitization or fog formation during subsequent sensitizing of the emulsion, or during its storage and coating.

EXAMPLES

EXAMPLE 1

Ostwald ripening rates of small-particle silver halide emulsions were determined using Rayleigh light scatter measurements. Details of the measurement method are disclosed in A. L. Smith, ed., *Particle Growth in Suspensions*, Academic Press, London, 1973, pp. 159–178. At a temperature of 25° C. and a pH of 6, 8 mM AgBr emulsions of about 50 nm initial diameter dispersed in 0.1% ossein gelatin (isoelectric point 4.9) containing 30 volume percent methanol and 20–28 mM $KNO_3$ in 1 mM KBr (pBr 3) were mixed with varying amounts of the neutral and acid-substituted ripening agents of Tables I and II. Turbidity changes as a function of time, which corresponded to AgBr growth rates, were measured at 436 nm. Growth rates were normalized with respect to the rate obtained in the absence of an added organic ripening agent; measurements were reproducible within 15%. The following results were obtained:

| Test | Ripener (conc. in mM) | Relative AgBr Growth Rate |
|---|---|---|
| 1 | N1 (0.01) | 1.3 |
| 2 | N1 (0.05) | 4.7 |
| 3 | A10 (0.1) | 1.2 |
| 4 | A10 (3.0) | 2.1 |
| 5 | N12 (0.01) | 1.9 |
| 6 | A16 (0.01) | 1.1 |
| 7 | A18 (0.3) | 1.8 |

Comparing the results for A10 with those of the results for N1, and the results for A16 with those of N12 demonstrates that under the test conditions an acid-substituted ripening agent was a less active AgBr growth accelerator than its neutral analog and thus required a higher concentration than the latter to exhibit similar activity. The acid-substituted thiourea A18 also showed relatively weak ripening activity under the test conditions.

Next, the AgBr growth rates, produced by combinations of ripeners, were determined by the above-described method. If there was no interaction between the ripeners themselves, the observed growth rate from the combination of ripeners would be the product of the rates observed for the individual compounds. Thus, for example, the relative rate for a combination of 0.01 mM A16 and 0.3 mM A18 calculated from the foregoing results of Tests 6 and 7 would be $1.1 \times 1.8$, or 2.0. An observed rate lower than that calculated would indicate an antagonistic effect between the ripeners. An observed rate higher than that calculated, on the other hand, would indicate a synergistic, superadditive effect between them.

The following are the calculated and observed relative AgBr growth rates for several combinations of ripeners:

| Test | Ripener Combination (conc. in mM) | Relative AgBr Growth Rates Observed | Calculated | Obs./Calc. |
|---|---|---|---|---|
| 8 | A18 (0.3) + A16 (0.01) | 2.1 | 2.0 | ~1 |
| 9 | A18 (0.3) + N12 (0.01) | 4.8 | 3.4 | 1.4 |
| 10 | A18 (0.3) + A10 (0.10) | 1.8 | 2.2 | 0.86 |
| 11 | A18 (0.3) + N1 (0.05) | 15 | 8.5 | 1.8 |
| 12 | A10 (3.0) + A16 (0.01) | 2.4 | 2.3 | ~1 |
| 13 | A10 (3.0) + N12 (0.01) | 4.9 | 4.0 | 1.2 |
| 14 | A10 (3.0) + N1 (0.05) | 35 | 9.9 | 3.5 |

The observed relative AgBr growth rate for the combination of the acid-substituted ripeners A18 and A16 (Test 8) was 2.1 which was very close to the value of 2.0 calculated above. Similarly, the observed rate for the combination of A10 and A16 (Test 12) was 2.4 which was nearly the same as the calculated value of 2.3. The combination of A18 and A10 (Test 10), however, yielded an observed rate that suggested a slight interference between the ripeners.

When the acid-substituted ripener A18 was combined with either of the neutral ripeners N12 or N1 (Tests 9 and 11), the observed growth rates were greater than those calculated by factors of 1.4 and 1.8, respectively, demonstrating a significant superadditive effect. Similarly, the acid-substituted A10 in combination with either of the neutral ripeners N12 or N1 (Tests 13 and 14) exhibited superadditivity with an observed/calculated growth rate of 3.5 for the A10-N1 combination. These results demonstrate the advantageous ripening activity of a combination of an acid-substituted organic ripening agent and a neutral organic ripening agent in accordance with the present invention.

EXAMPLE 2

Aliquots of a AgBr emulsion, as described in Example 1, were mixed with various ripening agents and ripened at 25° C., pH 6.8, and pBr 3 for 5 hours. The reactions were then quenched by the addition of N-ethyl-N'-sulfobutyl-9-methylthiacarbocyanine. The resulting AgBr crystals were determined by electronmicrography with the crystal sizes being expressed as equivalent circular diameters (ECD) in μm. The results were as follows:

| Test | Ripener(s) (conc. in mM) | AgBr Crystal Size EDC, μm |
|---|---|---|
| 1 | None | 0.023 |
| 2 | N11 (0.02) | 0.048 |
| 3 | A24 (0.10) | 0.047 |
| 4 | A24 (0.12) | 0.067 |
| 5 | A24 (0.10) + N11 (0.02) | 0.27 |

As shown in Test 2, the neutral ripener N11 at a concentration of 0.02 mM produced an approximate doubling of the AgBr crystal size compared with the noripener condition (Test 1). A concentration of 0.10 mM of the acid-substituted ripener A24 (Test 3) was required to achieve a similar result. The combination of 0.10 mM A24 and 0.02 mM N11 (Test 5), however, produced a greater than 10-fold increase in crystal size, demonstrating the remarkable advantage of combining an acid-substituted and a neutral organic ripening agent in accordance with the present invention.

EXAMPLE 3

Clearing time, defined as the time required for disappearance of the last visible traces of silver halide, was determined for a hardened AgBr emulsion coating containing 15.5 mg/dm$^2$ Ag. The technique employed was "split field visual photometry," in which strips of the emulsion coating on a transparent support were partially immersed in 0.5M aqueous sodium hydroxide containing 0.1 mM of the acid-substituted ripening agent A2 and varying amounts of other ripening agents. After all the silver halide had been removed from the immersed portion of the strip, the entire strip was immersed in the alkaline solution and agitated until the demarcation line formed by the initial partial immersion of the strip was no longer visually detectable. The clearing times at 25° C. thus determined for the various combination of silver halide solvents (ripening agents) were normalized with respect to the clearing time measured for the solution containing A2 as the only ripening agent. The test results, expressed as relative rates of emulsion clearing and reproducible within ±30%, were as follows:

| Test | Additional Ripener* (conc. in mM) | Relative Emulsion Clearing Rate |
|---|---|---|
| 1 | A1 (0.064) | 1 |
| 2 | N7 (0.064) | 2.6 |
| 3 | N15 (0.0064) | 5.2 |
| 4 | A10 (0.0064) | 1 |
| 5 | N1 (0.0064) | 4.8 |
| 6 | N12 (0.0064) | 8.2 |

*In addition to 0.1 mM A2 present in all solutions.

Addition of a second acid-substituted ripener such as A1 or A10 (Tests 1 and 4, respectively) produced no change in emulsion clearing rate relative to that obtained with A2 alone. However, addition of the neutral ripener N7 at a concentration of 0.064 (Test 2) increased the clearing rate by a factor of 2.6. Approximately five-fold rate enhancements were obtained with added N15 and N1 (Tests 3 and 5, respectively), even at the low concentration of 0.0064 mM. An even greater benefit was obtained with 0.0064 mM N12 (Test 6), which increased the relative clearing rate by a factor of 8.2. These results again demonstrate the advantageous results obtained from the combination of an acid-substituted and a neutral organic ripening agent in accordance with the present invention.

EXAMPLE 4

Ripening rates of a small-particle AgBr emulsion were determined, as described in Example 1, using the acid-substituted ripening agent A14 and the neutral ripening agent N12 singly and in combination. The following results were obtained:

| Test | Ripener(s) (conc. in mM) | Relative AgBr Growth Rates Observed | Calculated | Obs./Calc. |
|---|---|---|---|---|
| 1 | A14 (0.06) | 5.6 | | |
| 2 | N12 (0.01) | 1.8 | | |
| 3 | A14 (0.06) + N12 (0.01) | 157 | 10.1 | 15.5 |

From the growth rates observed with A14 and N12 alone (Tests 1 and 2, respectively), a relative growth rate of 10.1 was calculated for their use in combination. However the growth rate actually observed from the combination of 0.06 mM A14 and 0.01 mM N12 in accordance with the present invention was 157, a greater than 15-fold superadditivity enhancement.

Although the invention has been described in detail for the purpose of illustration, it is understood that such detail is solely for that purpose, and variations can be made therein by those skilled in the art without departing from the spirit and scope of the invention which is defined by the following claims.

What is claimed is:

1. A process of preparing a photosensitive silver halide emulsion comprising:

providing an emulsion containing $10^{-5}$ to 5 mole/liter of silver halide and comprising:

an anionic acid-substituted organic ripening agent present in a concentration of $10^{-6}$ to $10^{-1}$ mole/mole of silver halide and having the general formula (I) or (II)

$$(A)_aR^1[XR^2(A)_b]_m[YR^3(A)_c]_n \quad (I)$$

$$R^4(A)_dR^5(A)_eN-\underset{\underset{Z-R^6(A)_f}{|}}{C}=X \quad (II)$$

wherein each A is independently a covalently bonded acidic substituent;

$R^1$, $R^2$, $R^3$, $R^4$, and $R^6$ are independently hydrocarbon or fluorocarbon groups having from 1 to 6 carbon atoms, which groups are unsubstituted or substituted with one or more neutral functional groups containing heteroatoms selected from the group consisting of halogen, oxygen, sulfur, and nitrogen;

X is selected from the group consisting of S, Se, and Te; and

Y is selected form the group consisting of O, S, Se, and Te;

a, b, and c are independently 0, 1, or 2, and at least one of a, b, or c is greater than zero, m and n are independently zero to 6;

Z is selected from the group consisting of O, S, Se, Te, and $-NR^7(A)_g$, wherein $R^7$ is a lower hydrocarbon group which is unsubstituted or substituted as described from $R^1$, $R^2$, $R^3$, $R^4$, $R^5$, and $R^6$; d, e, f, and g are independently 0 or 1, and at least one of d, e, f, and g is 1; and a neutral organic ripening agent present in a concentration of 0.01 to 2.5 mole/mole of said acid-substituted organic ripening agent and having the general formula (III) or (IV)

$$R^1(XR^2)_m(YR^3)_n \quad \text{(III)}$$

$$R^4R^5N-\underset{\underset{Z-R^6}{|}}{C}=X \quad \text{(IV)}$$

wherein m and n are independently zero to 6;

$R^1$, $R^2$, $R^3$, $R^4$, $R^5$, and $R^6$ are independently hydrocarbon or fluorocarbon groups having from 1 to 6 carbon atoms, which groups are unsubstituted or substituted with one or more neutral functional groups containing heteroatoms selected from the group consisting of halogen, oxygen, sulfur, and nitrogen;

X is selected from the group consisting of S, Se, and Te; and

Y is selected from the group consisting of O, S, Se, and Te; and

Z is selected from the group consisting of O, S, Se, Te, and $-NR^7$, wherein $R^7$ is a hydrocarbon group which is unsubstituted or substituted as described for $R^1$, $R^2$, $R^3$, $R^4$, $R^5$, and $R^6$; and growing silver halide grains in the emulsion.

2. A process according to claim 1, wherein the acid substituent of said acid-substituted organic ripening agent has a pKa from about 1 to about 8.

3. A process according to claim 2, wherein the acid substituent of said acid-substituted organic ripening agent has a pKa from about 3 to about 6.

4. A process according to claim 1, wherein $R^1$ is linked with $R^2$ or $R^3$ to form a cyclic group having fewer than 36 ring atoms.

5. A process according to claim 1, wherein m is 2 and each $R^2$ independently contains one or more divalent groups or atoms selected from the group consisting of —CO—, —O—, $-CONR^8-$, —S(O)—, $-S(O_2)-$, or $-SO_2NR^8-$, wherein $R^8$ is a lower hydrocarbon group which is unsubstituted or substituted as described for $R^1$, $R^2$, $R^3$, $R^4$, $R^5$, and $R^6$.

6. A process according to claim 1, wherein $R^4$ and $R^6$ or $R^4$ and $R^5$ are linked to form a 5- or 6-membered heterocyclic ring, which is unsubstituted or substituted as described for $R^1$, $R^2$, $R^3$, and $R^5$.

7. A process according to claim 6, wherein said heterocyclic ring is selected from the group consisting of an azole, imidazolidine, thiazolidine, thiazoline and morpholine.

8. A process according to claim 1, wherein said functional groups are independently selected from the group consisting of —OH, $-COR^9$, $-OR^9-CONHR^9$, $-SO_2NHR^9$, and $-SO_2R^9$, wherein $R^9$ is a lower hydrocarbon group which is unsubstituted or substituted as described for $R^1$, $R^2$, $R^3$, $R^4$, $R^5$, and $R^6$.

9. A process according to claim 1, wherein said acidic substituents are independently selected from the group consisting of —CONHOH, $-OPO(OR')H$, $-PO(R')OH$, —COOH, $-SO_3H$, $-SO_2H$, $-SeO_3H$, $-SeO_2H$, $-CH(CN)_2$, —SH, $-SO_2SH$, —SeH, $-SO_2SeH$, —CONHCOR', $-CONHSO_2R'$, $-SO_2NHSO_2R'$, and $-CR'=NOH$, where R' is H or a lower alkyl or aryl group.

10. A process according to claim 9, wherein said acidic substituents are —COOH groups.

11. A process according to claim 1, wherein said acid-substituted organic ripening agent is selected from the group consisting of glycine, 4,5-dicarboxyimidazole, $Te(CH_2COOH)_2$, $(CH_2OCH_2CH_2SCH_2CH_2COOH)_2$, $(CH_2SCH_2COOH)_2$, $(CH_2SCH_2CH_2SCH_2COOH)_2$, $O(CH_2CH_2OCH_2CH_2SCH_2CH_2SCH_2CH_2COOH)_2$, $(CH_2OCH_2CH_2SCH_2CH_2SCH_2CH_2COOH)_2$, $O(CH_2CH_2SCH_2CH_2COOH)_2$, 1,10-dithia-4,7,13,16-tetraoxacyclooctadecane-5-carboxylic acid, 1,10-dithia-4,7,13,16-tetraoxacyclooctadecane methyleneoxyacetic acid, $[HOOC(CH_2)_3]N(CH_3)CSN(CH_3)[(CH_2)_3COOH]$, $(CH_2OCH_2CH_2SeCH_2CH_2COOH)_2$,

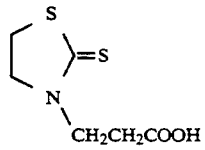

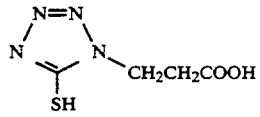

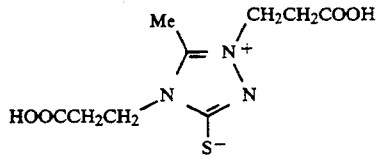

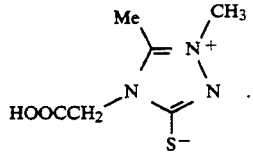

12. A process according to claim 1, wherein said neutral organic ripening agent is selected from the group consisting of $(CH_2SCH_2OH)_2$, $(CH_2OCH_2CH_2SCH_2CH_2OH)_2$, $(CH_2OCH_2CH_2SCH_2CH_2OCH_3)_2$, $Te(CH_2CH_2OH)_2$, $CH_2(CH_2TeCH_2CH_2OH)_2$, $(CH_2OCH_2CH_2SeCH_2CH_2CH_2OH)_2$, ethanolamine, $(CH_2OCH_2CH_2SeCH_2CH_2CONHEt)_2$, 1,10-dithia-4,7,13,16-tetraoxacyclooctadecane, 1,10-diselena-4,7,13,16-tetraoxacyclooctadecane, $Me_2NCSNMe_2$,

N17

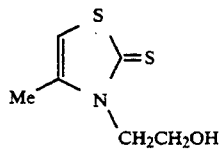

N18

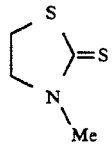

-continued

N19

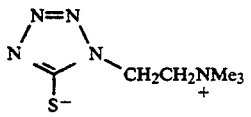

N20

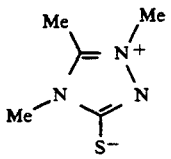

N21

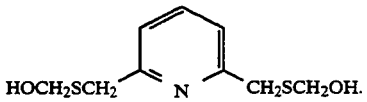

13. A process according to claim 1, wherein the concentration of silver halide in said emulsion is from $10^{-3}$ to 2 mole/liter, the concentration of said acid-substituted ripening agent is from $10^{-4}$ to $10^{-2}$ mole/mole of silver halide, and the concentration of said neutral organic ripening agent is from 0.05 to 0.5 mole/mole of acid-substituted organic ripening agent.

14. A silver halide emulsion made by the process of claim 1.

15. A photosensitive silver halide element with a support bearing the emulsion of claim 14.

16. A silver halide emulsion made by the process of claim 11.

17. A photosensitive silver halide element with a support bearing the emulsion of claim 16.

18. A silver halide emulsion made by the process of claim 12.

19. A photosensitive silver halide element with a support bearing the emulsion of claim 18.

* * * * *

IN THE UNITED STATES PATENT AND TRADEMARK OFFICE

CERTIFICATE OF CORRECTION

PATENT NO. : 5,246,827

DATED : September 21, 1993

INVENTOR(S) : Arthur H. Herz et al.

It is certified that errors appear in the above-identified patent and that said Letters Patent is hereby corrected as shown below:

Col 14, line 51, after "$R^4$," insert --- $R^5$, ---.

Col 14, line 60, delete "form" and insert --- from ---.

Col 14, line 68, delete "from" and insert --- for ---.

Col 14, line 68, after "$R^6$, begin a new subparagraph beginning with --- d, e, ---

Signed and Sealed this

Eighth Day of November, 1994

*Attest:*

*Attesting Officer*

Bruce Lehman

BRUCE LEHMAN

*Commissioner of Patents and Trademarks*